United States Patent [19]

Beeber

[11] 4,035,186

[45] July 12, 1977

[54] PROCESS FOR THE DEVELOPMENT OF DIAZOTYPE MATERIALS

[75] Inventor: Allan Robert Andrew Beeber, London, England

[73] Assignees: Allan Robert Andrew Beeber; Ozalid Group Holdings Limited, both of England

[21] Appl. No.: 633,090

[22] Filed: Nov. 18, 1975

[30] Foreign Application Priority Data

Nov. 20, 1974 United Kingdom ..... 50202/74

[51] Int. Cl.[2] ..... G03C 5/34

[52] U.S. Cl. ..... 96/49; 96/91 R

[58] Field of Search ..... 96/49, 91 R

[56] References Cited

U.S. PATENT DOCUMENTS

| | | | |
|---|---|---|---|
| 1,926,322 | 12/1930 | Van der Grinten et al. | 96/91 R |
| 2,241,104 | 5/1941 | Van der Grinten | 96/49 |
| 2,500,096 | 3/1950 | Slifkin | 96/49 |
| 3,446,620 | 5/1969 | Parker | 96/49 |
| 3,479,183 | 11/1969 | Habib et al. | 96/91 R |
| 3,512,978 | 5/1970 | Lubar | 96/49 |
| 3,615,484 | 10/1971 | Yoshida | 96/49 |
| 3,615,487 | 10/1971 | Moraw et al. | 96/49 |
| 3,622,325 | 11/1971 | Toshida | 96/49 |
| 3,809,560 | 5/1974 | Neuman | 96/49 |
| 3,912,512 | 10/1975 | Kumins | 96/49 |

OTHER PUBLICATIONS

Dinaburg; M. S., "Photosensitive Diazo Cpds," 1965, The Focal Press, p. 124–127.

Kosar; J., "Light–Sensitive Systems," 1965, J. Wiley & Sons, p. 255–259.

*Primary Examiner*—Charles L. Bowers, Jr.

*Attorney, Agent, or Firm*—Birch, Stewart, Kolasch and Birch

[57] ABSTRACT

A process for the development, following imagewise exposure, of two component diazotype material in sheet form constituted by a base carrying a light-sensitive coating containing a diazonium salt, a coupler, and an acid coupling inhibitor, said process comprising, while advancing the material continuously at a rate of 1 to 20 meters per minute, first applying to the exposed light-sensitive coating a non-volatile alkaline, inorganic developer liquid having a pH value of at least 10 at a coating weight between 2.0 and 8.0 grams per square meter to effect, in the unexposed areas of the material, coupling between the diazonium salt and the coupler, then subjecting the material to heat sufficient to dry it and finally applying to the light-sensitive coating a dilute acid solution at a coating weight between 2.0 and 8.0 grams per square meter, said acid solution containing sufficient acid not only to neutralize alkali retained in the material but to leave the emerging material in a substantially acid condition.

5 Claims, 1 Drawing Figure

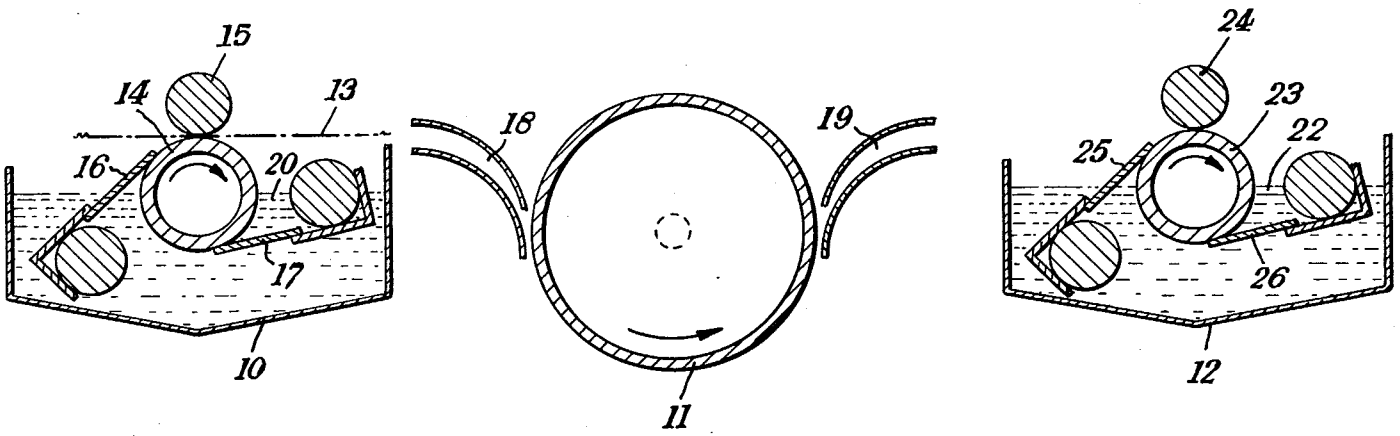
24
23
22
26
12
25
19
11
18
13
20
17
10
15
14
16

PROCESS FOR THE DEVELOPMENT OF DIAZOTYPE MATERIALS

There are two types of diazotype copying materials, namely the two component type and the single component type.

A material of the two component type has a light-sensitive coating which includes a diazonium salt, a coupler, usually a hydroxy compound, and an acid inhibitor to prevent premature coupling of the diazonium compound with the coupler to form a dyestuff. Upon imagewise exposure of the material to suitable radiation under an original, the diazonium salt is decomposed in the exposed areas. The material is then developed by exposing it to an alkaline medium, usually moist ammonia gas. This, by neutralizing the inhibitor, causes the undecomposed diazonium salt to combine immediately with the coupler to form a dyestuff.

A material of the single component type has a light-sensitive coating which contains no coupler. Development after imagewise exposure is effected by application to the material of an alkaline or neutral liquid developer containing a coupler.

The two component method has the advantages of giving dry points of good contrast and clean background and by suitable choice of the diazonium salt and the coupler, a range of coloured images can be produced. A disadvantage is that ammonia gas is poisonous, and in spite of all precautions ammonia gas cannot be prevented from entering the working atmosphere. Anti-pollution legislation and public fear of pollution are tending to inhibit the sale of equipment using ammonia for development.

The single component method avoids pollution but has the disadvantage that the diazotype material must be passed through the developing machine considerably more slowly than is possible with a machine which develops two component material by exposure to ammonia gas in order to prevent the prints from emerging in an unduly wet condition.

Proposals have recently been made to utilize amines in place of ammonia for the development of two component material, but the procedure is viewed with disfavour by Public Health Authorities because amines are powerful irritants to the skin and eyes and their use accordingly involves a risk to health.

Although it is possible to produce by both the two component and the single component methods as practised at present prints which initially have a clean white background, the background tends to discolour and become yellow upon prolonged exposure to light.

It is possible to obviate the hygienic disadvantages attendant upon the use of ammonia or amines as the alkali in the development of two-component diazotype material by applying to the exposed material an inorganic alkaline solution, for example an aqueous solution of sodium carbonate. This provides effective and rapid development, but has been found to be commercially unacceptable because the background of the prints becomes yellow in a few hours.

The present invention is based on the appreciation that the tendency to discolouration of the background of developed diazonium prints is due to the presence of residual alkali in the prints, and resultant chemical action either on the paper constituting the base, the light-decomposition product of the diazonium salt or both, and that the reason why discolouration takes place far more slowly when ammonia is used for development than when a solution of sodium carbonate is used is that, in the former case, the bulk of the ammonia disappears from the print by evaporation leaving very little residual alkali. As will be appreciated, it is impracticable in practice to apply only just that amount of alkali necessary to ensure a suitable environment for coupling so that an excess of alkali must inevitably be applied to the exposed material.

This consideration led the inventor to appreciate that it might be possible to avoid this tendency to discolouration by applying to the developed prints sufficient acid to neutralize any residual alkali left in the prints and this has proved to be the case. Nevertheless, considerable research has been involved in establishing conditions under which such subsequent acidification of the prints can be effected while nevertheless enabling the resulting development procedure to be carried out at a commercially acceptable speed, comparable with that obtainable in a conventional developing machine which uses ammonia gas.

The invention provides a process for the development, following imagewise exposure, of two component diazotype material in sheet form constituted by a base carrying a light-sensitive coating containing a diazonium salt, a coupler, and an acid coupling inhibitor, said process comprising, while advancing the material continuously at a rate of 1 to 20 meters per minute, first applying to the exposed light-sensitive coating a non-volatile alkaline, inorganic developer liquid having a pH value of at least 10 at a coating weight between 2.0 and 8.0 grams per square meter to effect, in the unexposed areas of the material, coupling between the diazonium salt and the coupler, then subjecting the material to heat sufficient to dry it and finally applying to the light-sensitive coating a dilute acid solution at a coating weight between 2.0 and 8.0 grams per square meter, said acid solution containing sufficient acid not only to neutralize alkali retained in the material but to leave the emerging material in a substantially acid condition.

It has been found that prints having prolonged freedom from background discolouration when exposed to daylight can be produced providing the resulting prints have a pH value of 4 to 5.5, when measured by the Pye pH Meter and Surface Electrode, Model Dynacap 403–30. The testing procedure involved consists in applying a drop of water to the print, and then applying the electrode of the Meter to the drop, whereupon the Meter gives a direct reading of pH value.

Preferably the alkaline developer liquid is an aqueous solution of a carbonate, bicarbonate, hydroxide or phosphate of an alkali metal or an alkaline earth metal. While water soluble carbonates, bicarbonates, hydroxides and phosphates of all alkali and alkaline earth metals. particularly sodium, potassium, calcium, strontium and barium can be used, solutions of potassium carbonate and sodium carbonate are preferred.

The heating stage which follows the alkaline treatment serves two purposes. Firstly the diazotype material is dried thus obviating carry over of alkaline solution into an acid solution and thus hastening the neutralization by the final acid bath. Also the temperature of the paper or film base of the material is considerably raised, so increasing the reaction rate between the acid and the residual alkali. When the coating weights of the alkali and acid are as stated above, brief heating of the material, e.g. to 100° C. for twenty seconds, will ensure emergence of the material from the developing machine in a substantially dry condition notwithstanding that the material is fed through the machine at the rate of 1 to 15 meters per minute.

The nature of the acid used is not critical, although it is desirable to use an acid which does not readily crystallize from solution. Examples of preferred acids are phosphoric, sulphuric, hydrochloric, citric, lactic, oxalic, tartaric, polyacrylic and benzene sulphonic acids.

The use of strongly oxidising acids, such as nitric and perchloric acid, should in general be avoided when the base of the diazotype material is paper, because of the tendency of such acids to char paper. Formic, acetic and some halogenated aliphatic acids, while effective, are not preferred because of their tendency to impart an odour to the prints.

The formulation of the light-sensitive coating of the two component diazotype material is in no way critical. The process is operative on all commercially available two component materials irrespective of the nature of the diazonium salt or the coupler which can be chosen at will in accordance with the colour of print desired.

An embodiment of developing apparatus suitable for carrying out the process according to the invention is illustrated in the accompanying diagrammatic drawing.

The apparatus includes a tank 10 containing the alkaline developer liquid 20, an internally heated cylinder 11 and a tank 12 containing the acid solution 22. Sheets 13 of two component diazotype material, after being subjected to imagewise exposure under an original in the conventional manner, are fed in succession, light-sensitive coating downmost, from the exposure station (not shown) to the nip between a pair of rollers 14, 15. The roller 14 is a driven roller partly immersed in the developer liquid 20 and the coating weight of developer liquid applied to the sheets 13 is controlled by doctor blades 16, 17. The sheets pass, from the nip between the rollers 14, 15, through a guide 18, around the periphery of the cylinder 11 and through another guide 19 to the nip between another pair of rollers 23, 24. The temperature of the cylinder 11 is sufficient to ensure drying of the sheets before they reach the nip between the rollers 23, 24. The roller 23 is a driven roller and is partially immersed in the acid solution 22. Doctor blades 25, 26 control the coating weight of the acid solution applied to the sheets.

In a typical embodiment of the process, the following two component diazotype material was subjected to development as stated below. The diazotype material was produced by applying to a paper base, at a coating weight of 15 grams per square meter, the following coating solution:

| | |
|---|---|
| Water | 1 litre |
| Diethyleneglycol | 50 ml |
| Citric acid | 30 g |
| 2-hydroxy-3-naphthoic acid 3-morpholinopropylamide | 30 g |
| 4-morpholino-2,5-diethoxy-benzenediazonium chlorozincate | 25 g |
| Zinc chloride | 40 g |
| Thiourea | 40 g |

After imagewise exposure to ultra violet light the material was roller coated with liquid from an alkaline developing bath of the following composition:

| | % by weight: |
|---|---|
| Anhydrous potassium carbonate | 15.50 |
| Glycerol | 18.00 |
| Wetting agent Invadine SF (Obtainable from CIBA GEIGY(UK)LTD) | 0.50 |
| Water | 66.00 |
| | 100.00% |

The alkaline liquid was applied at a coating weight of 4.0 grams per square meter. After heating to a temperature of 100° C for 20 seconds by passage around the heated cylinder the material was roller coated, at a coating weight of 4.0 grams per square meter, with the following acid solution:

| | % by weight: |
|---|---|
| Water | 60.50 |
| Phosphoric acid | 6.17 |
| Polyethylene glycol | 25.60 |
| Invadine SF | 1.00 |
| Poly acrylic acid (Versicol E7 obtainable from ALLIED COLLOIDS LTD.) | 6.73 |
| | 100.00% |

The procedure was repeated, using the same diazotype material, the same heating conditions and the same coating weights of alkaline and acid solutions but the compositions of the baths were as follows:

| | |
|---|---|
| **Alkaline Bath** | |
| Deionised water | 1800 mls |
| Glycerol | 600 mls |
| Potassium carbonate (anhydrous) | 400 grms |
| Zirgel K mordant (from Magnesium Elektron Ltd.) | 50 grms |
| Tween 20 wetting agent (from Kochlight | 10 mls |
| Invadine A wetting agent (from Ciba Geigy) | 40 mls |
| Tetrahydrofurfuryl alcohol | 70 mls |
| **Acid Bath** | |
| Deionised water | 1600 mls |
| Zinc chloride, 70% aqueous solution | 120 mls |
| 90% phosphoric acid | 30 mls |
| Lactic acid | 70 mls |
| Polyethyleneglycol, mean molecular weight 400 | 200 mls |
| Tween 20 | 5 mls |
| Supronic B75 wetting agent (ABM Chemicals Ltd.) | 1 ml |
| Glycol | 20 mls |
| Polyvinyl alcohol Versicol E7 | 80 mls |

In both experiments a good quality print was obtained, consisting of a blue image on a white background, which withstood exposure to daylight for a long period without discolouration.

The polyethylene glycol present in each acid bath serves as a humectant and also to confer on the solution sufficient viscosity for effective application to the sheets notwithstanding the low speed of rotation of the roller used to apply the solution. The mordant in the alkaline bath in the second example was incorporated for the purpose of stabilizing the image on the print.

What I claim as my invention and desire to secure by Letters Patent is:

1. A process for the development, following imagewise exposure, of two component diazotype material in sheet form constituted by a base carrying a light-sensitive coating containing a diazonium salt, a coupler, and an acid coupling inhibitor, said process comprising, while advancing the material continuously at a rate of 1 to 20 meters per minute, first applying to the exposed light-sensitive coating a non-volatile alkaline, inorganic developer liquid selected from the group consisting of aqueous solutions of carbonates, bicarbonates, hydroxides and phosphates of alkali metals and alkaline earth metals and having a pH value of at least 10 at a coating weight of between 2.0 and 8.0 grams per square meter to effect, in the unexposed areas of the material, coupling between the diazonium salt and the coupler, then subjecting the material to heat sufficient to dry it, and finally applying to the light-sensitive coating a dilute acid solution at a coating weight of between 2.0 and 8.0 grams per square meter which contains acid which does not readily crystallize from solution, does not tend to char paper and does not impart an objectionable odor to the resulting prints, said acid solution containing sufficient acid not only to neutralize alkali retained in the material but to leave the emerging material in a substantially acid condition.

2. A process according to claim 1, wherein the emerging material has a pH value of 4 to 5.5, when measured by the Pye pH Meter and Surface Electrode, Model Dynacap, 403–30.

3. A process according to claim 1, wherein the acid is selected from the group consisting of phosphoric, sulphuric, hydrochloric, citric, lactic, oxalic, tartaric, polyacrylic and benzene sulphonic acids.

4. A process according to claim 1, in which the alkaline and acid solutions are applied to the material by rollers.

5. A process according to claim 1, in which heating is effected by passing the material around a heated cylinder after coating with said developer liquid and prior to application of said acid solution.

* * * * *